US005087032A

United States Patent [19]

Gresh

[11] Patent Number: 5,087,032

[45] Date of Patent: Feb. 11, 1992

[54] GRIP EXERCISER USED WITH WEIGHT ASSEMBLY

[76] Inventor: Peter Gresh, 437 Lark Ave., Miami Springs, Fla. 33166

[21] Appl. No.: 515,579

[22] Filed: Apr. 27, 1990

[51] Int. Cl.[5] ..... A63B 21/072

[52] U.S. Cl. ..... 272/68; 272/119; 272/122; 272/137

[58] Field of Search ..... 272/67, 68, 117, 122, 272/123, 124, 135-143

[56] References Cited

U.S. PATENT DOCUMENTS

| | | | |
|---|---|---|---|
| 654,097 | 7/1900 | Sandow | 272/68 |
| 965,284 | 7/1910 | Dossetter | 272/122 X |
| 1,026,215 | 5/1912 | Korth | 272/68 |
| 1,119,169 | 12/1914 | Kepple | 272/122 |
| 1,138,459 | 5/1915 | Day | 272/122 |
| 1,353,938 | 9/1920 | Schurr | 272/68 |
| 3,134,590 | 5/1964 | Young | 272/122 X |
| 3,734,493 | 5/1973 | Hasekian | 272/122 |
| 4,192,500 | 3/1980 | Crow et al. | 272/117 X |
| 4,351,526 | 9/1982 | Schwartz | 272/122 |
| 4,515,364 | 5/1985 | Rotella | 272/122 X |
| 4,627,618 | 12/1986 | Schwartz | 272/122 |
| 4,691,915 | 9/1987 | Sutton | 272/137 X |
| 4,753,434 | 6/1988 | Salvino | 272/135 X |
| 4,783,067 | 11/1988 | Palmer | 272/68 |
| 4,830,361 | 5/1989 | Hoffman | 272/117 X |
| 5,033,740 | 7/1991 | Schwartz et al. | 272/122 X |

FOREIGN PATENT DOCUMENTS

| | | | |
|---|---|---|---|
| 196482 | 4/1923 | United Kingdom | 272/68 |

*Primary Examiner*—Robert Bahr

*Attorney, Agent, or Firm*—Malloy, Downey & Malloy

[57] ABSTRACT

A combined weight assembly preferably in the form of a dumbbell with a grip exerciser device removably secured thereto such that the user can exercise appropriate muscle groups by lifting the weights associated with the dumbbell and, concurrently, exercise and strengthen his grip by manipulating the grip exerciser device removably attached to the dumbbell at the portion thereof where the user normally grips the dumbbell during exercising.

9 Claims, 3 Drawing Sheets

GRIP EXERCISER USED WITH WEIGHT ASSEMBLY

BACKGROUND OF THE INVENTION

1. Field of the Invention 4 This invention relates to a combined dumbbell or like weight assembly and grip exerciser device attached thereto and being structured and disposed relative to the weight assembly such that the user can exercise and strengthen his grip while utilizing the dumbbell in the intended manner.

2. Description of the Prior Art

Weight assemblies, commonly known as dumbbells, are extensively used for exercise and the development of certain muscle groups. Typically, such dumbbell type structures include a weight supporting bar having two spaced apart weight structures fixedly or removably attached thereto. When utilizing such conventional dumbbells or weight assembly, only the intended muscle groups are exercised and, therefore, developed.

In an effort to render an exercising technique more efficient, the prior art has developed certain grip exercising or like devices to be used with dumbbells so that both the grip and the selected muscle group can be concurrently developed. Such prior art assemblies are generally represented in the following U.S. patents. U.S. Pat. No. 1,026,215 to Korth, discloses a grip dumbbell wherein the fixed dumbbell structure has a grip exercising device with only one handle or gripping portion secured to the dumbbell by inserting a non-gripping portion into the interior thereof. Exercise of the g rip is accomplished by selectively "squeezing" the outwardly extending grip portion thereby forcing it towards the dumbbell. Korth does not show a grip exerciser which can be completely detached from the dumbbell structure and used independently thereof.

U.S. Pat. No. 1,113,791 to Latella and U.S. Pat. No. 1,229,658 to Sandow, both disclose dumbbells specifically structured to include as important components thereof a handle or grip structure which serves to exercise the grip of the user while the user is also exercising with the dumbbells and taking advantage of the weights associated therewith. The structure disclosed in both of these patents utilize biasing springs to generate resisting force to the grip. Again, neither of these structures can be used independently of the dumbbell as a grip exerciser device.

U.S. Pat. No. 965,284 to Dossetter and U.S. Pat. No. 2,263,135 to Johnson, both disclose an exercise including a grip means associated with some type of dumbbell or weight structure, but specifically wherein the grip exercising or testing device is considered a part thereof and not operable independently of any dumbbell or weight.

Other structures existing in the prior art are shown in U.S. Pat. No. 2,814,491 to Proctor and U.S. Pat. No. 4,681,315 to Yang. In these structures, generally hand grips use some type of spring or like mechanism as a force generating device resisting the closing or squeezing thereof and therefore exercising the grip of the user.

SUMMARY OF THE INVENTION

The present invention relates to a grip exerciser the type to be removably attached to a weight assembly generally in the form of a dumbbell. The grip exerciser device may take a variety of structural configurations in the various embodiments set forth herein and described in greater detail hereinafter. One preferred embodiment includes the exerciser device having two spaced apart hand gripping portions interconnected by a biasing spring generally in the form of a coil spring located at one end thereof. Attempts to position or "squeeze" the hand gripping portions towards one another will present resistance to the user and thereby serve to exercise the grip. The aforementioned exercise device is removably secured to the dumbbell and, more particularly, is removably attached to a channel-shaped member defining a mid-portion of the weight supporting bar. The weight supporting bar of the dumbbell has its opposite ends attached either fixedly or removably to two weight structures. In addition, the U-shaped channel of the mid-portion of the weight support bar includes an outwardly extending head which is similarly configured to at least partially engage or retain the aforementioned biasing spring therein. One of the gripping portions extends outwardly from the weight support bar such that both the weight support bar and the outwardly extending gripping portion may be simultaneously gripped by the user. The user may, therefore, lift the weights to exercise certain designated muscle groups as well as "squeeze" the exercise device thereby also exercising his grip.

In another embodiment of the present invention, a base has an interior chamber which is inflatable. The base is formed primarily of a flexible and resilient material. A centrally located sleeve is disposed and dimensioned to substantially surround the mid-portion of the weight supporting bar between the weights. The inflated chamber and the outer surface of the base extends outwardly from the weight support bar to the extent of allowing it to be gripped by the user of the dumbbell. Continuous squeezing of the base will serve to exercise the grip concurrently to the use of the dumbbell or weight assembly in the prescribed manner.

A similar modification of the above set forth embodiment is the base being the base and the interior chamber being effectively filled with a sponge or like readily resilient, but compressible material. In this embodiment, the base also includes a central sleeve which is concentrically positioned in surrounding relation about the mid-portion of the weight supporting bar and between the weights attached thereto. The compressibility of the material on the interior of the chamber and the fact that the chamber itself is made from a flexible, somewhat resilient material allows compression or squeezing of the base while the user also serves to exercise with the dumbbell in the prescribed manner.

Another embodiment of the present invention comprises a plurality of elastic material bands connected in spaced, substantially parallel relation to one another. Such connections are made by attaching opposite ends of each of the plurality of bands to the weights in a manner which allows the bands to be removed and/or replaced, etc. In this embodiment, at least one of the bands and preferably at least two of the bands are disposed such that either one of the bands and the mid-portion of the weight bar may be gripped or ultimately both of oppositely disposed bands and the mid-portion of the weight support bar may be gripped in order that the dumbbell or the weight assembly may be used in the prescribed manner while concurrently exercising the grip due to the fact that the bands present resistance force as should be apparent.

In each of the embodiments set forth above, it should be apparent that at least one gripping portion extends outwardly from the mid-portion of the weight support bar. A distance sufficient to allow the user of the dumbbell to concurrently grip this one gripping portion as well as the weight support bar in a manner which will allow continuous and/or repetitive squeezing of the outwardly extending gripping portion towards the weight support bar thereby serving to provide the proper exercise to the user's grip as desired.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
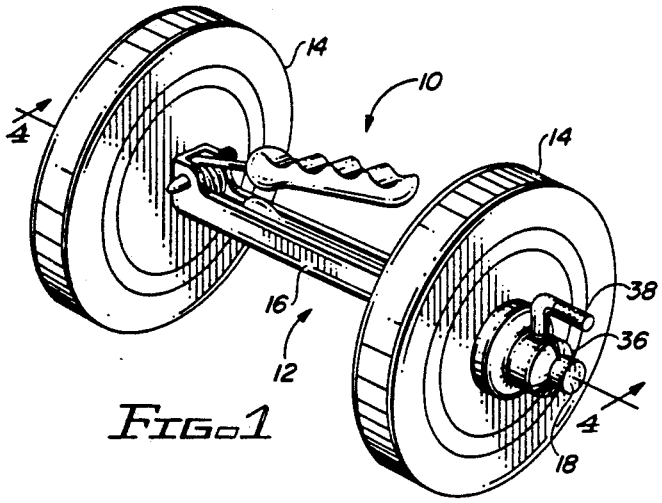
FIG. 1 is a perspective view of one preferred embodiment of the present invention.
Figure 3:
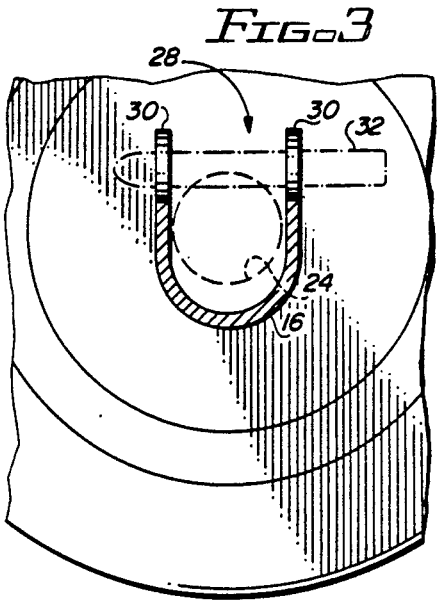
FIG. 3 is a sectional view along line 3—3 of FIG. 2.
Figure 4:
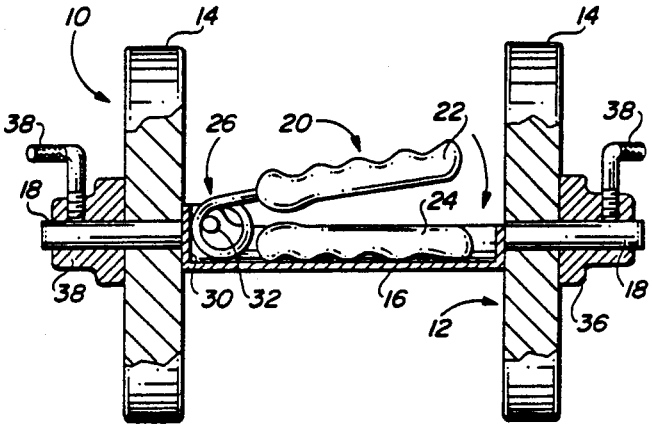
FIG. 4 is a longitudinal sectional view along line 4—4 of FIG. 1.
Figure 2:
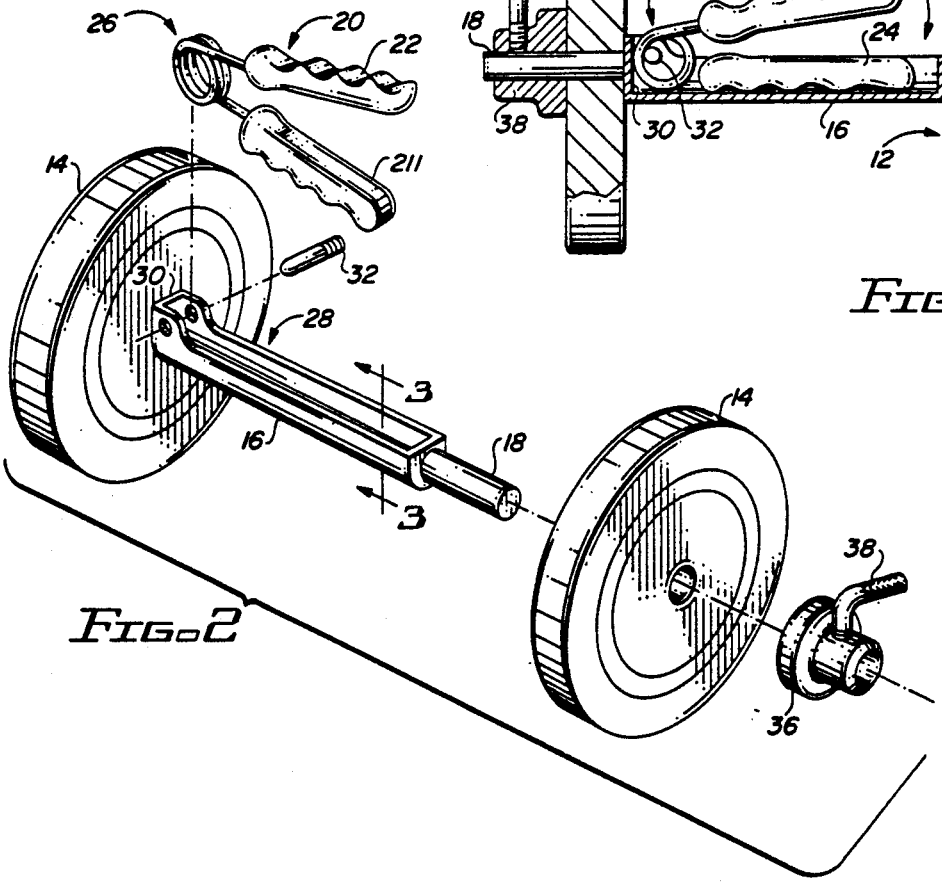
FIG. 2 is a perspective view of the embodiment of FIG. 1 in exploded form.

One preferred embodiment of the present invention is shown in FIGS. 1-4 and is generally indicated as 10. The device of the present invention includes the combination of a dumbbell structure 12 including two weight structures 14 removably attached to opposite ends of a weight supporting bar 16 as at 18. An exercise device generally indicated as 20 comprises two hand gripping portions 22 and 24 connected at one end by a biasing spring 26 in the form of a coil spring member having opposite ends thereof secured to the gripping portions 22 and 24. The movement of the gripping portions 22 and 24 towards one another, as by squeezing of the user's hand, offers resistance to such movement and, therefore, serves to exercise the grip of the user. An important feature to the present invention is the existence of a channel means integrally formed on and being part of the weight support bar 16 and being located between the weights 14. The channel means is generally indicated as 28 in FIGS. 2-3 and comprises a substantially U-shaped transverse configuration along at least the majority of its length being of sufficient dimension to retain on the interior thereof one of the hand gripping portions 24. Similarly, the channel 28 includes a head portion 30 extending substantially outwardly from the remainder of the channel means 28 and also having a somewhat U-shaped interior spring 26 therein in a manner clearly shown in FIGS. 1, 2, and 4. The other or what may be considered a first gripping portion 22 extend outwardly from the mid-portion of the weight supporting bar 16 at a location where both the weight supporting bar 16 and the gripping portion 22 can be concurrently gripped by the user. This allows both the exercise of the user's body through manipulation of the dumbbell or the weight assembly 12 and the user of the grip exerciser device 20.

The grip exerciser device 20 is removably attached to the dumbbell structure 12 primarily by means of a connecting pin or the like 32 passing through apertures formed in the walls of the head portion 30 and also passing through substantially the center of the biasing spring 26.

As shown in the embodiment of FIGS. 1-4, as well as the remaining embodiments, the weights 14 can be removably attached by an appropriate positioned locking collar 36 tied to the appropriate end 18 of the weight supporting bar 16 by an L-shaped locking bolt 38.

Figure 5:
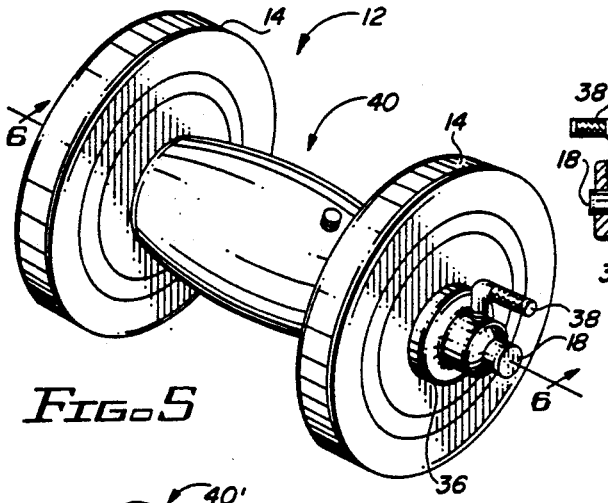
FIG. 5 is a perspective view of yet another embodiment of the present invention.
Figure 6:
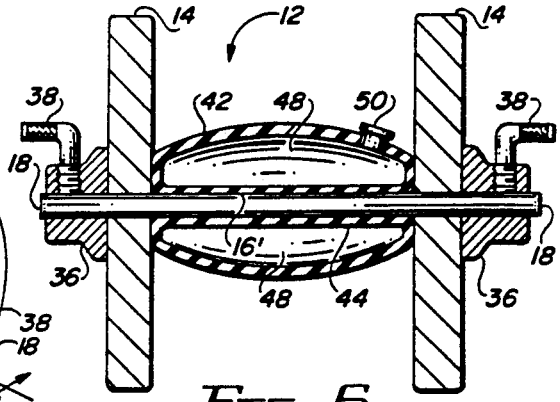
FIG. 6 is a longitudinal sectional view along line 6—6 of FIG. 5.

The embodiment of FIGS. 5-6 of the grip exerciser device is generally indicated as 40 and comprises a flexible and resilient material base 42 having a centrally disposed sleeve or the like as at 44 slidingly engaging the outer surface of the mid-portion of the weight support bar as at 16'. Removal of the base 42 can easily occur upon removal of one of the weights 14 thereby allowing the base to slide from the surrounding and concentric relation to the mid-portion of the weight support bar as at 16'. The base 42 has an interior chamber as at 48 which may be inflated with air or any other applicable fluid through a valve assembly 50. The flexibility and resiliency from which the material of the base 42 is made allows the base to expand outwardly from the support bar 16' and opposite portions of the base 42 provide hand gripping portions for the user. It should be obvious that resistant force is provided by squeezing the base 42 against the pressure of the inflated fluid within the interior chamber 48 while concurrently exercising with the dumbbell 12.

Figure 7:
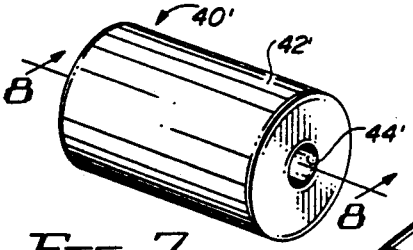
FIG. 7 is a perspective view of a component of yet another embodiment of the present invention.
Figure 8:
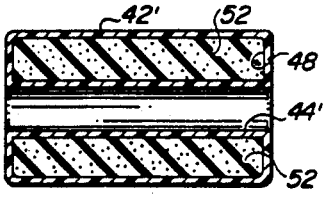
FIG. 8 is a longitudinal sectional view along line 8—8 of FIG. 7.

A similar embodiment is disclosed in FIGS. 7 and 8 wherein the exercise device 40' comprises a base 42' having an interior portion as at 48' filled with a soft, compressible, yet resilient material such as but not also provided for surrounding, concentric relation to the weight support bar 16' allowing it to be selectively inserted into its operative position between the weights or removed therefrom as desired.

Figure 10:
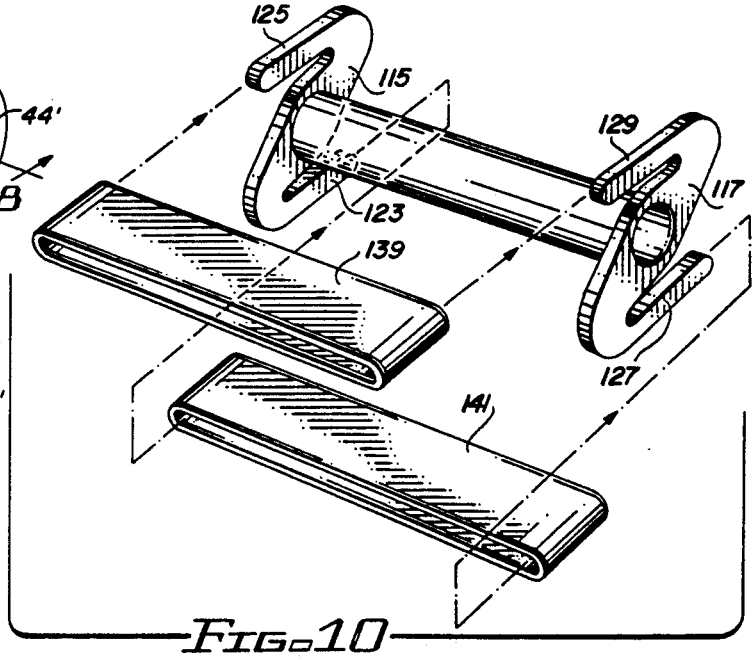
FIG. 10 is an exploded perspective view of some of the components of the embodiment of FIG. 9.
Figure 9:
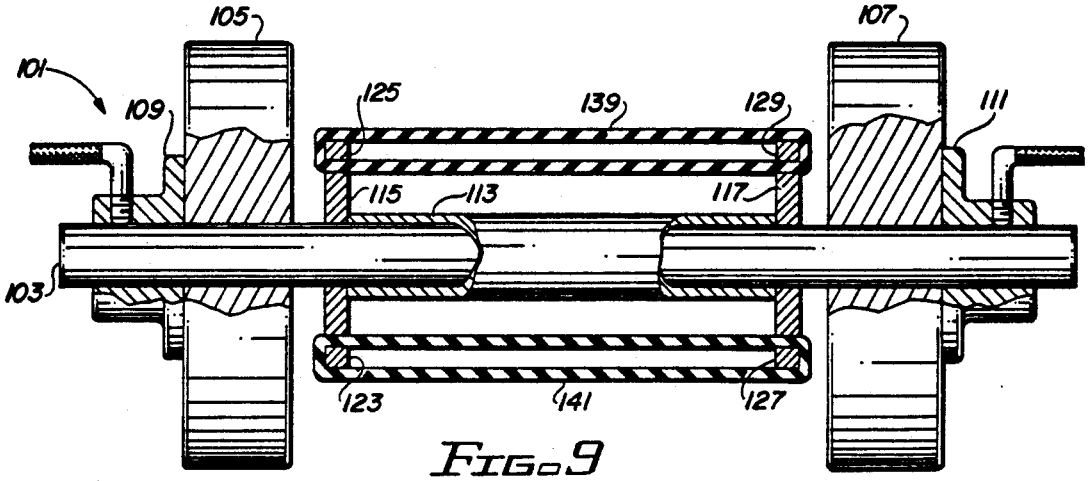
FIG. 9 is a view in cross section of yet another preferred embodiment of the present invention on a standard dumbbell device.

Referring now to FIG. 9, a standard dumbbell 101 is shown which is composed of a shaft 103 on which two weights 105 and 107 are secured by conventional means, such as keepers 109 and 111. Referring to FIG. 10, this preferred embodiment includes a sleeve 113 sized for telescopic attachment on the central zone of the shaft. On each of the ends of the sleeve, there is provided a retaining bracket such as 115 and 117. The upper and lower end zone of the brackets are each provided with a finger such as 123, 125, 127, and 129. These fingers are adapted to be spanned by a resistance band, such as 139 and 141.

In use, bands are selected of desired tension and installed as shown in FIG. 9. FIG. 10, the exploded view, shows the relative arrangement of these parts.

Figure 11:
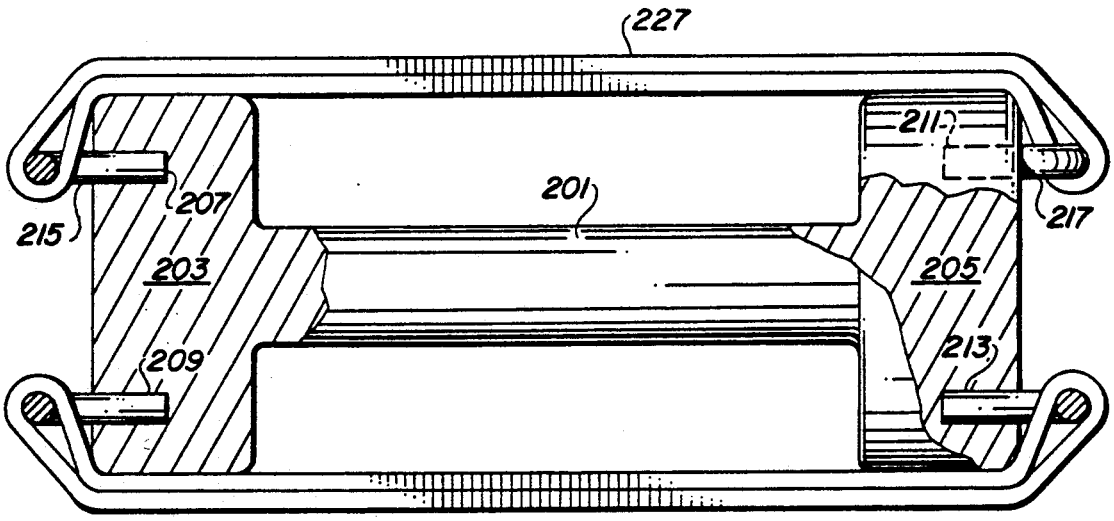
FIG. 11 is a view in cross section of another embodiment of the invention.
Figure 12:
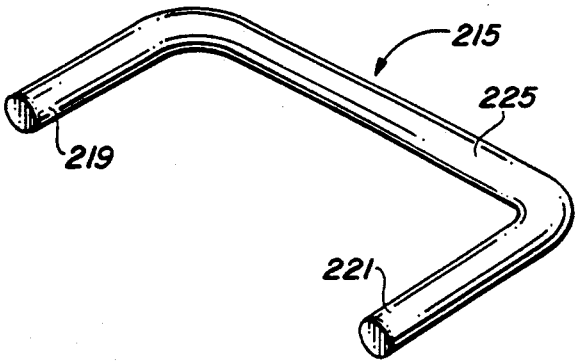
FIG. 12 is a perspective view of the U-shaped clip designated by the numeral 215 in FIG. 11.
Figure 13:
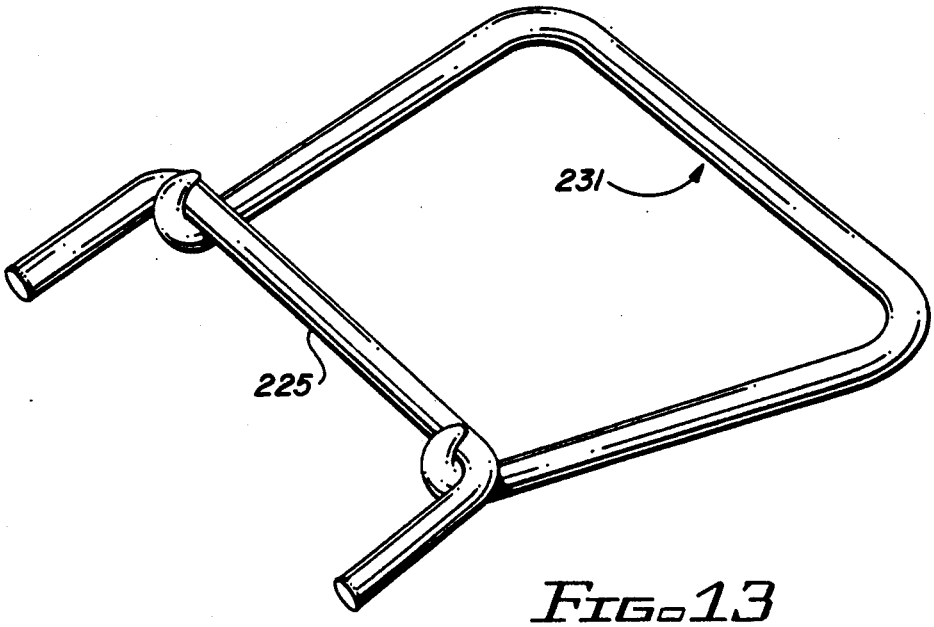
FIG. 13 is a perspective view of a tool used with this embodiment.

A further embodiment is seen in FIG. 11. It is composed of a dumbbell 201 with weighted ends 203 and 205, the end faces of which are provided with pairs of recesses, such as 207, 209, 211 and 213. These pairs of recesses, such as 207, are adapted to receive a U-shaped clip, such as 215 and 217, see 215 in FIG. 12, the legs 219 and 221 of which are sized to loosely fit therein with the clip base 225 may be spanned by a tension band, such as 227, see FIG. 11. To remove the clips, a clip removal tool 231 in the form a dual hooked member may be provided, see FIG. 13. In use, the bands of desired tension are installed as shown.

Now that the invention has been described,

What is claimed is:

1. In combination, a dumbbell structure and a grip exerciser device for concurrently exercising the grip while lifting the dumbbell, said combination comprising:

said dumbbell structure including a weight supporting bar and two weight structures each attached adjacently to an opposite end of said weight support bar in spaced apart relation, said grip exerciser device comprising spaced apart gripping portions structured to resist movement of said gripping portions towards one another, said grip exerciser device secured to said dumbbell such that said gripping portion is defined between said weight structures, said grip exerciser device being disposed to position said gripping portions outwardly in spaced relation to said weight support bar, said grip exerciser device including a biasing means removably attached to said dumbbell and disposed and structured to resist movement of said gripping portions towards said weight support bar, said biasing means including a pair of flexible, resilient non-metallic bands being sufficiently taught to resist movement thereof, and being disposed on opposite sides of said weight support bar in spaced relation thereto, such that a hand or foot may be inserted therebetween, and attachment means for securing said biasing means to said dumbbell.

2. An assembly as in claim 1 wherein each of said bands are disposed in parallel relation to one another and at least two of said plurality of bands are disposed on opposite sides of said weight support bar.

3. A combination as recited in claim 2 wherein said attachment means includes a pair of U-shaped clips structured and disposed to attach opposite ends of each of said bands to said weight structures.

4. A combination as recited in claim 3 wherein each of said weight structures includes a plurality of spaced apart recesses, structured and disposed to receive said U-shaped clips therein.

5. A combination as recited in claim 4 including removal means structured and disposed to facilitate removal of said U-clips from said recesses in said weight structures.

6. A combination as recited in claim 5 wherein said removal means includes a U-shaped dual hook member having hooked portions at both distal ends which are structured and disposed to adaptively fit around said U-clips.

7. A combination as recited in claim 2 wherein said attachment means includes an elongate, centrally disposed sleeve dimensioned to removably surround and slidingly engage said weight support bar.

8. A combination as recited in claim 7 wherein said sleeve is disposed between said weight structures and includes a pair of retaining brackets disposed at opposite distal ends thereof.

9. A combination as recited in claim 8 wherein said retaining brackets have a generally Z-shaped configuration structured and disposed to receive an end of each of said bands over an opposite distal end thereof, such that said bands are stretched between said retaining brackets on said opposite distal ends of said sleeve.

* * * * *